US006873822B2

(12) United States Patent
Tomono et al.

(10) Patent No.: US 6,873,822 B2
(45) Date of Patent: Mar. 29, 2005

(54) IMAGE FORMING APPARATUS

(75) Inventors: Toshiro Tomono, Ibaraki (JP); Makoto Kitahara, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 10/630,805

(22) Filed: Jul. 31, 2003

(65) Prior Publication Data

US 2004/0022565 A1 Feb. 5, 2004

(30) Foreign Application Priority Data

Aug. 1, 2002 (JP) ..... 2002-225046

(51) Int. Cl.[7] ..... G03G 15/00; G03G 15/16; B65H 29/00

(52) U.S. Cl. ..... 399/401; 399/107; 399/297; 399/364; 399/391; 399/393; 271/184; 271/185; 271/902

(58) Field of Search ..... 399/401, 364, 399/297, 107, 391, 393; 271/184, 185, 902

(56) References Cited

U.S. PATENT DOCUMENTS

| | | | | | |
|---|---|---|---|---|---|
| 4,627,709 | A | | 12/1986 | Kitajima et al. | 355/14 SH |
| 4,900,009 | A | | 2/1990 | Kitahara et al. | 271/296 |
| 5,086,320 | A | * | 2/1992 | Koike | 399/401 |
| 5,110,104 | A | | 5/1992 | Wakao et al. | 271/3.1 |
| 5,186,454 | A | | 2/1993 | Kitahara | 271/288 |
| 5,252,018 | A | | 10/1993 | Kitahara et al. | 412/11 |
| 5,743,521 | A | | 4/1998 | Munakata et al. | 271/263 |
| 5,927,702 | A | * | 7/1999 | Ishii et al. | 271/9.09 |
| 5,940,543 | A | * | 8/1999 | Isemura et al. | 382/284 |
| 5,983,064 | A | * | 11/1999 | Green et al. | 399/341 |
| 6,148,172 | A | * | 11/2000 | Kanda et al. | 399/391 |
| 6,325,585 | B1 | * | 12/2001 | Sasaki et al. | 412/11 |
| 6,477,352 | B2 | * | 11/2002 | Takahashi et al. | 399/401 |
| 6,496,679 | B2 | | 12/2002 | Kitahara | 399/310 |
| 6,539,198 | B2 | * | 3/2003 | Miyajima | 399/389 |
| 6,567,644 | B1 | * | 5/2003 | Yasui | 399/401 |
| 6,615,018 | B2 | * | 9/2003 | Funato | 399/322 |
| 6,782,236 | B2 | * | 8/2004 | Sasaki et al. | 399/401 |

* cited by examiner

*Primary Examiner*—Andrew H. Hirshfeld
*Assistant Examiner*—Marvin P. Crenshaw
(74) *Attorney, Agent, or Firm*—Fitzpatrick, Cella, Harper & Scinto

(57) ABSTRACT

A sheet re-feeding path (32) is disposed substantially horizontally at a location below a fixing unit (14) and an image forming unit. At a location below the sheet re-feeding path (32), sheet decks (3, 4) are disposed horizontally along a sheet conveying direction in the sheet re-feeding path (32). Also, a drawing path (37) for switchbacking the sheet is disposed substantially horizontally between the sheet re-feeding path (32) and the sheet decks (3, 4). A sheet feeding path (7) for feeding the sheet from the sheet deck (3) disposed at an upstream side crosses the drawing path (37) to join to the sheet re-feeding path (32). Accordingly, a space, which is occupied by component parts or devices related to the conveyance of the sheet, can be made compact, whereby sheet capacity can be increased.

16 Claims, 9 Drawing Sheets

IMAGE FORMING APPARATUS

BACKGROUND OF THE INVENTION

1. Field of the Invention

The present invention relates to an image forming apparatus capable of conveying sheets with images formed thereon at one side thereof so as to again form images thereon at the other side thereof while reversing them.

2. Description of the Related Art

With regard to image forming apparatuses such as copying machines, printers or the like, there is a demand for increasing the number of sheet cassettes and/or sheet capacity of the sheet cassettes without changing or increasing the size or installation space of an apparatus main body. Cassettes having a width equal to that of the apparatus main body can flexibly accommodate varying sizes such as from a smaller size of A4 to a larger size of A3 or the like, but when the cassettes contain A4 size sheets, waste spaces being not actually used will be created.

In view of such a situation, consideration is given to the arrangements of cassettes and/or sheet decks so as to make effective use of the space inside the apparatus main body. For instance, special sheet cassettes dedicated to smaller sizes up to A4 are arranged in an empty space inside the apparatus main body, or two small cassettes or sheet decks less in width than the apparatus main body are arranged side by side in the right and left (i.e., widthwise or transverse) direction with a large cassette capable of accommodating a larger size being disposed thereunder, so as to meet the users' demand of increasing sheet capacity of the cassettes or sheet decks.

In copying machines and printers, the volume occupied by image forming units is increasing in order to achieve coloring in recent years, but in this case, it becomes difficult to keep both the size of the apparatus main body and the sheet capacity at levels equal to those in the conventional ones. Also, in monochrome machines, the demand for further increasing sheet capacity is increasing.

Thus, in order to meet the demand of increasing the sheet capacity while keeping the size of the apparatus main body equal to that of the conventional one, it is necessary to reduce the space occupied by those component parts or devices which are associated with the conveyance of the sheets.

Moreover, in conventional image forming apparatuses in which sheet cassettes or sheet decks are vertically arranged one over another, paper jams caused in a sheet reversing path 101, as shown in FIG. 9, have been cleared or remedied by opening a side door of an apparatus main body. FIG. 9 is a cross sectional view of such a conventional image forming apparatus.

Therefore, in cases where sheet finishing applications such as a sorter, a finisher, etc., are arranged at a side of the apparatus main body at which the side door is disposed, it is necessary to separate these sheet finishing applications from the apparatus main body for handling or clearing paper jams, thus resulting in poor usability as well as requiring an ample space for the separation of the sheet finishing applications.

SUMMARY OF THE INVENTION

Accordingly, an object of the present invention is to increase sheet capacity without enlarging an apparatus main body, by making compact the space occupied by those component parts or devices which are related to conveying the sheets.

Another object of the present invention is to improve usability or convenience in handling upon occurrence of paper jams. Bearing the above object in mind, in one aspect, the present invention resides in an image forming apparatus comprising:

a plurality of sheet storage means;

image forming means for forming an image on a sheet fed from any of the sheet storage means;

a sheet re-feeding path for guiding again the sheet, which has a first image formed on one side surface thereof by means of the image forming means, to the image forming means so as to form a second image on the other side surface of the sheet; and a drawing path for drawing in the sheet to switchback it when the sheet having the first image formed thereon is sent to the sheet re-feeding path;

wherein the sheet re-feeding path is disposed substantially horizontally at a location below the image forming means;

the drawing path is disposed substantially horizontally between the sheet re-feeding path and the plurality of sheet storage means; and a sheet feeding path for feeding the sheet from the sheet storage means crosses the drawing path to join to the sheet re-feeding path.

In another aspect, the present invention resides in an image forming apparatus comprising:

a pair of sheet decks disposed in a horizontal direction in an apparatus main body for storing sheets, respectively;

an image forming unit disposed at a location above the pair of sheet decks;

a sheet feeding path connecting the sheet deck and the image forming unit with each other;

an output tray disposed at a side of the apparatus main body;

a sheet discharge path connecting the image forming unit and the output tray with each other;

a drawing path branching from the sheet discharge path so as to be disposed substantially horizontally at a location above the pair of sheet decks; and a sheet re-feeding path disposed substantially horizontally between the drawing path and the image forming unit for connecting the sheet discharge path and the sheet feeding path with each other;

wherein the sheet feeding path connected from one of the pair of sheet decks to the image forming unit crosses the drawing path to be connected with the sheet re-feeding path, whereby the sheet feeding path serves as a part of the sheet re-feeding path.

DESCRIPTION OF THE PREFERRED EMBODIMENTS

Now, a preferred embodiment of the present invention will be described below in detail, by way of example, while referring to the accompanying drawings. However, it is to be understood that the measurements, materials, configurations, relative arrangements and the like of component parts described in the following embodiment are only illustrative but should not be construed as limiting the range of legal protection for the present invention in any manner, in particular unless specified otherwise.

In addition, in the following description and figures in the accompanying drawings, the like or same parts as those described in the aforementioned figure are identified by the same symbols.

(One Embodiment of Image Forming Apparatus)

Figure 1:
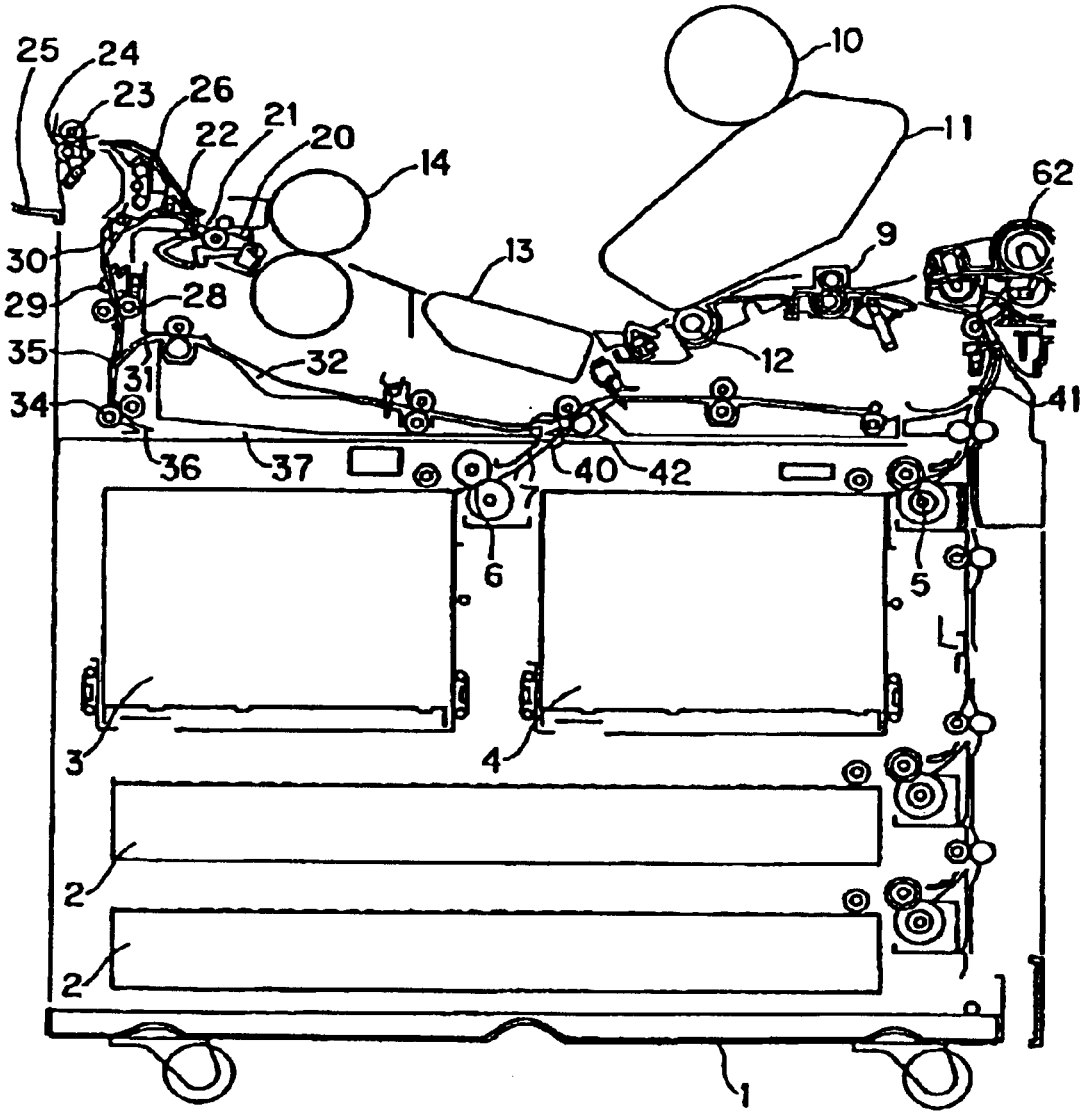
FIG. 1 is across sectional view of a printer as one embodiment of an image forming apparatus according to the present invention.
Figure 2:
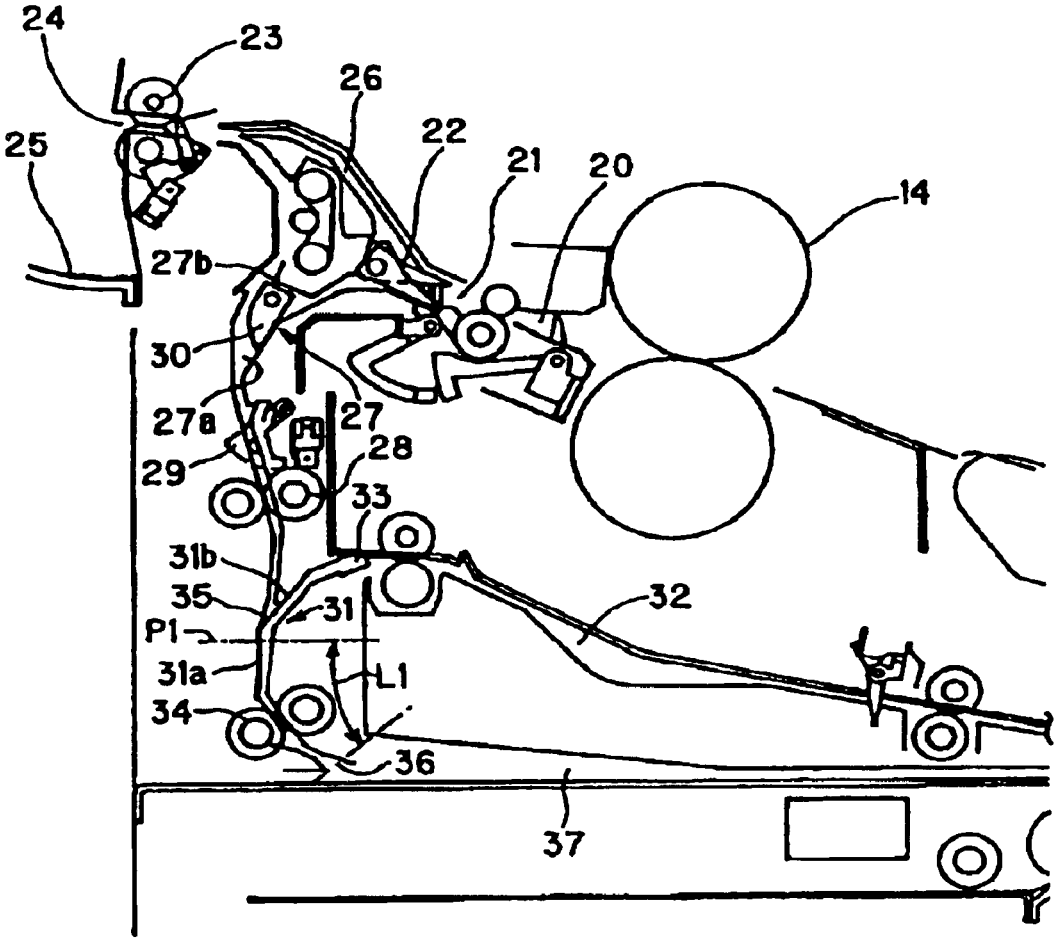
FIG. 2 is a cross sectional view of a sheet reversing path of the image forming apparatus shown in FIG. 1.

Hereinafter, a preferred embodiment of an image forming apparatus according to the present invention will be described while referring to the accompanying drawings. FIG. 1 is a cross sectional view of a printer as an embodiment of an image forming apparatus according to the present invention, and FIG. 2 is a cross sectional view of a sheet reversing path in the image forming apparatus shown in FIG. 1.

The printer 1 feeds sheets selectively from a manually sheet tray (not shown), sheet cassettes 2, 2 or sheet decks 3, 4 so as to form an image thereon.

The sheet decks 3, 4 capable of storing sheets of small sizes are arranged above the sheet cassettes 2 and at the left and right sides of the main body of the printer 1.

An operator is able to replenish the sheet cassettes 2 and the sheet decks 3, 4 with sheets by pulling them out in a frontward or nearside direction (i.e., in a direction perpendicular to the plane of the drawing).

The sheets stored in the right-hand sheet deck 4 are successively fed and conveyed by a sheet feeder 5 while being separated one from another. The sheets stored in the left-hand sheet deck 3 are successively fed by a sheet feeder 6 while being separated one from another, and conveyed to join to an intermediate portion of a sheet re-feeding path 32 to be described in detail later through a sheet feeding path 7.

A sheet, being fed and delivered from either of the manually sheet tray (not shown), the sheet cassettes 2 and the sheet decks 3, 4 storing sheets of small sizes, passes through a registration introduction path 41 to arrive at a registration unit 9, where oblique feeding or skewing of the sheet is corrected. The sheet being thus subjected to skew correction is conveyed to an image forming unit while being synchronized therewith, the image forming unit comprising a photosensitive drum 10, an intermediate transfer belt 11, a secondary transfer roller 12, a charger (not shown), a development unit (not shown), etc.

Then, a toner image, being formed on the surface of the photosensitive drum 10 based on a signal of image information sent from a reader scanner (not shown), a personal computer (not shown), etc., is transferred on the sheet.

The sheet having the toner image transferred thereto are further conveyed to a fixing unit 14 by means of a pre-fixing conveying portion 13, so that the toner image transferred to the surface of the sheet is permanently fixed to the sheet by the fixing unit 14.

In the printer 1 according to this embodiment, an exposure unit in the form of an LED for forming a toner image on the surface of the single photosensitive drum 10 is arranged in opposition to the surface of the photosensitive drum 10. Here, note that the exposure unit is not limited to the LED but may be a laser plus polygon mirror system.

Also, the number of photosensitive drums and the number of development units are not particularly limited in any manner, but the present invention is equally applicable to a printer using four photosensitive drums and four development units, as well as to a monochrome machine having one photosensitive drum and one development unit.

Now, reference will be made to the conveyance of the sheet after the toner image has been fixed thereon while referring to FIG. 1 and FIG. 2. The sheet having the toner image fixed thereon by means of the fixing unit 14 passes through a post-fixing sheet conveying path 20 so as to be received in a sheet receiving opening 21.

Immediately at the downstream of the sheet receiving opening 21, there is tiltably arranged a conveying direction selection means in the form of a discharge flap 22 for switching over the sheet conveying direction.

Also, a pair of discharge rollers 23 are arranged for discharging the sheet with the image formation having been finished from a sheet discharge opening 24 to the outside of the printer 1. The sheet discharged from the sheet discharge opening 24 is loaded onto an output tray 25. The sheet receiving opening 21 and the sheet discharge opening 24 are connected with each other by a sheet discharge path 26.

In addition, the sheet receiving opening 21 and the sheet discharge opening 24 are also connected with each other by a switchback reversing path 27, which serves to guide the sheet for discharge while reversing or turning it inside out. The switchback reversing path 27 is formed into a Y-shaped configuration, so that it is connected with the sheet receiving opening 21, the sheet discharge opening 24 and an escape or side path 27*a*, respectively.

A pair of discharge sheet reversing rollers 28 and a sheet reversal sensor 29, which together constitute a sheet reversing means, are arranged on the escape path 27*a* of the switchback reversing path 27.

The discharge sheet reversing rollers 28 serve to once convey the sheet received from the sheet receiving opening 21 to the escape path 27*a*, and thereafter they are caused to rotate in the reverse direction so as to send the sheet to the sheet discharge opening 24.

At this time, the sheet is guided to the sheet discharge opening 24 under the action of a sheet reversing and discharging flap 30 arranged at a branch portion 27*b* of the switchback reversing path 27.

Here, it is to be noted that in the above-mentioned construction, the switchback reversing path 27, the escape path 27*a*, the branch portion 27*b*, the sheet reversing and discharging flap 30 and the discharge sheet reversing rollers 28 together constitute a sheet reversing and discharging means of the present invention.

A sheet reversing path 31 for reversing the sheet to be again conveyed to the image forming unit is connected with the escape path 27*a* of the above-mentioned switchback reversing path 27.

The sheet reversing path 31 is formed into a Y-shaped configuration, so that it is connected with the escape path 27*a* of the switchback reversing path 27, a sheet delivery opening 33, which is in the form of a guide opening for guiding the sheet having been reversed inside out to the sheet re-feeding path 32 to again convey the sheet to the image forming unit, and an escape path 31*a*, respectively. A guide piece 35, being elastic with its tip end at the escape path 31*a* side acting as a free end, is arranged at a branch portion 31*b* of the sheet reversing path 31.

A sheet reversing and conveying means in the form of a pair of sheet reversing rollers 34 is arranged at the escape path 31*a* of the sheet reversing path 31.

The sheet reversing rollers 34 serve to once convey the sheet, which has been received from the sheet receiving opening 21 and passed through the escape path 27*a* of the switchback reversing path 27, to the escape path 31*a* of the sheet reversing path 31, and thereafter it is caused to rotate in the reverse direction so as to send the sheet from the escape path 31*a* to the sheet delivery opening 33.

At this time, the sheet is guided to the sheet delivery opening 33 by means of the guide piece 35 arranged at the branch portion 31*b* of the sheet reversing path 31.

The guide piece 35 serves to guide the sheet from the escape path 27*a* of the switchback reversing path 27 to the escape path 31*a* of the sheet reversing path 31, but inhibit the sheet from being guided from the escape path 31*a* of the sheet reversing path 31 to the escape path 27*a* of the switchback reversing path 27.

A sheet escape opening 36 is formed at a downstream end of the escape path 31*a* of the sheet reversing path 31. The sheet escape opening 36 is a guide opening that serves to guide a portion of the sheet extended from the escape path 31*a* to a drawing path 37 when the length of the sheet is greater than the length L1 of a portion of the escape path 31*a* from a reversal stop position P1. Here, note that the drawing path 37 is not provided with any sheet conveying means.

In the above-mentioned construction, the sheet reversing path 31, the escape path 31*a*, the branch portion 31*b*, the sheet reversing rollers 34, the guide piece 35 and the drawing path 37 together constitute a sheet reversing means.

The sheet reversed by the sheet reversing means is again sent to the image forming unit through the sheet re-feeding path 32 which is disposed substantially horizontally at a location above the sheet decks 3, 4 respectively disposed at the right and left sides of the apparatus main body. In this manner, an image can also be formed on the rear or reverse surface of the sheet.

The drawing path 37 for drawing in the sheet to be conveyed to the sheet re-feeding path 32 for reversal of the sheet is arranged substantially in parallel with the sheet re-feeding path 32 at a location below the sheet re-feeding path 32 and above the left-hand and right-hand sheet decks 3, 4. Upper members of the left-hand sheet deck 3 and the right-hand sheet deck 4 are used to form the drawing path 37.

Here, note that the sheet feeding path 7 for conveying the sheet fed from the left-hand sheet deck 3 joins to an intermediate portion of the sheet re-feeding path 32. Also, the drawing path 37 is arranged to cross an intersection 40 at which the sheet feeding path 7 and the sheet re-feeding path 32 join to each other.

Therefore, in this embodiment, a gate 42 is arranged at the intersection 40 of the sheet feeding path 7, the sheet re-feeding path 32 and the drawing path 37 so as to ensure conveyance stability. The operation of this gate 42 will be described later.

Figure 3:
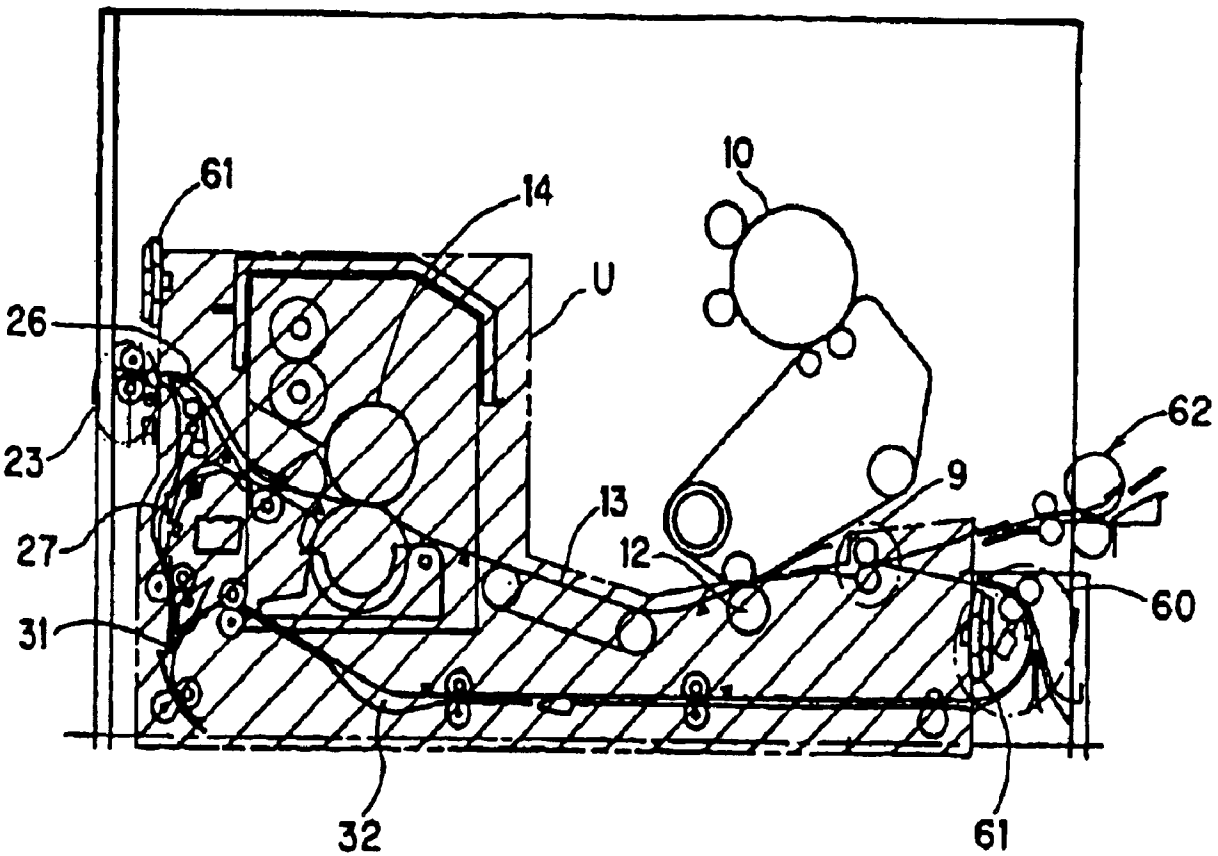
FIG. 3 is a schematic view of a sheet conveying frame provided by the image forming apparatus shown in FIG. 1.

Subsequently, the construction for handling or clearing paper jams will be described in detail while referring to FIG. 3. FIG. 3 is a schematic view of a sheet conveying frame that is provided by the image forming apparatus shown in FIG. 1.

The registration unit 9, the secondary transfer roller 12, the pre-fixing conveying portion 13, the fixing unit 14, the sheet discharge path 26, the switchback reversing path 27, the sheet reversing path 31 and the sheet re-feeding path 32, indicated by hatching in FIG. 3, are constructed as an integral unit U.

The unit U can be pulled or drawn out forwardly (in a direction perpendicular to the plane of FIG. 3) while being supported by rails 61, 61 which are arranged almost right over the discharge rollers 23 of the apparatus main body and in the vicinity of a pre-registration conveying unit 60, respectively.

Of the component parts or devices related to conveying sheets, those which remain in the apparatus main body when the unit U is drawn out therefrom are the discharge rollers 23, the pre-registration conveying unit 60, a manually-fed-sheet conveying unit 62 and the sheet feeding path 7 alone.

By constructing the component parts or devices related to the conveyance of sheets so as to be drawn out as the integral unit U when sheet jams are handled or cleared, it is possible to reduce the space occupied by the component parts or devices of this apparatus related to conveying sheets in comparison with conventional ones which are constructed such that a plurality of component mechanisms related to conveying sheets can be pulled out individually.

In addition, the space reduced by integrating the various component parts or devices into the unit U can be utilized as a space for storing sheets, so that the sheet capacity can be increased while keeping the size of the apparatus main body equal to those of the conventional ones.

Moreover, the direction of drawing of the unit U is the same as the direction of drawing of the sheet cassettes 2 and the sheet decks 3, 4, and these parts can be drawn or pulled out from the front side of the apparatus main body at which an operation panel of the image forming apparatus is arranged. Accordingly, the operator can perform a sheet supplying operation and a paper jam handling operation from the front side of the apparatus main body, thus making it possible to improve operational efficiency.

Figure 4:
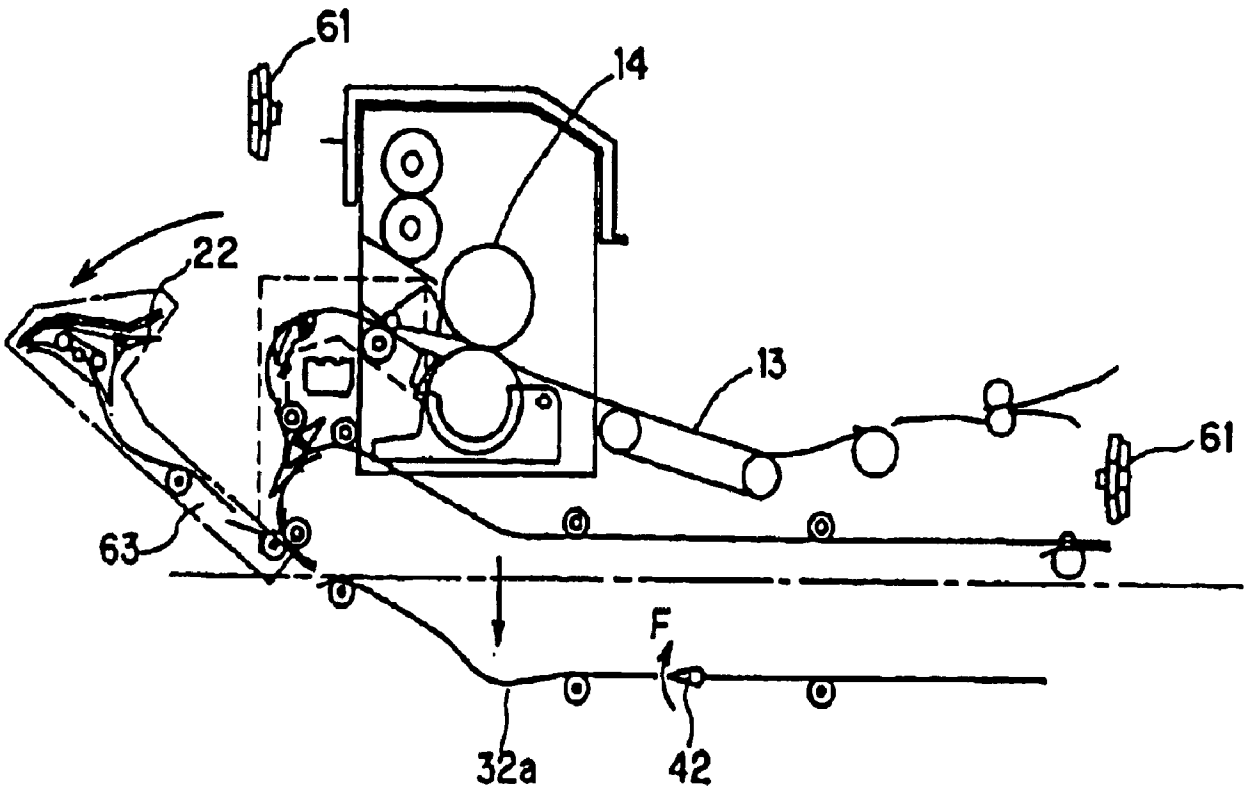
FIG. 4 is a schematic view showing an operation of the image forming apparatus shown in FIG. 1 when paper jams in respective portions of the apparatus are handled or cleared after a unit having various functions and devices combined therewith has been drawn out.
Figure 5:
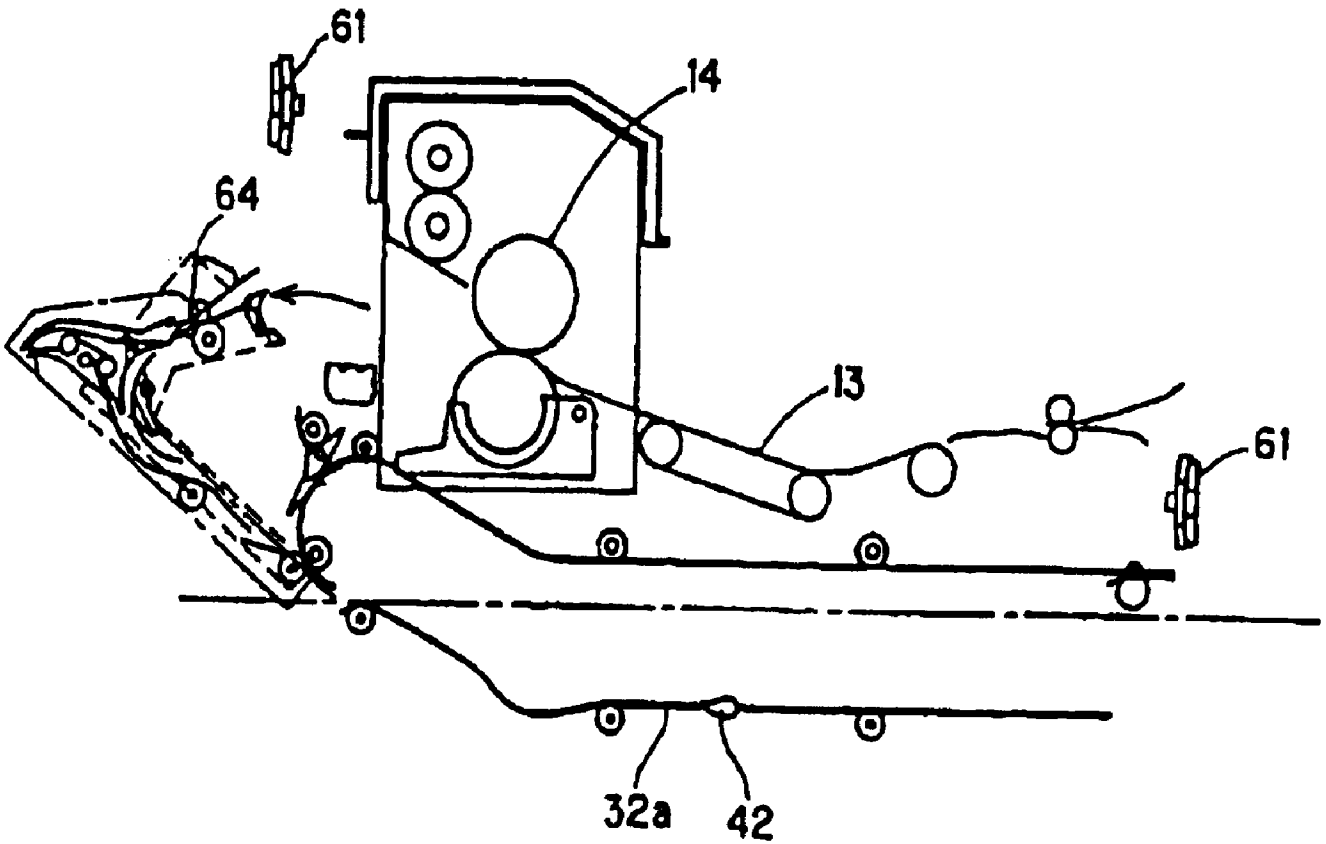
FIG. 5 is a schematic view showing the operation of the image forming apparatus shown in FIG. 1 when paper jams in respective portions of the apparatus are handled or cleared after the unit has been drawn out.

Next, reference will be made to the construction for handling or clearing paper jams in respective portions of the apparatus after the unit U has been drawn out therefrom while referring to FIG. 4 and FIG. 5. FIG. 4 and FIG. 5 are schematic views showing the operation of the apparatus in clearing paper jams in the respective portions of the apparatus after the unit U in the image forming apparatus shown in FIG. 1 has been drawn out therefrom.

As shown in FIG. 4 and FIG. 5, an outer door 63 of the apparatus is provided with the discharge flap 22, a sheet conveying guide of the switchback reversing path 27, a sheet conveying guide of the sheet reversing path 31 and a sheet conveying guide of the sheet discharge path 26.

Also, an inner door 64 of the apparatus is provided with the discharge flap 22, another sheet conveying guide of the switchback reversing path 27, another sheet conveying guide of the sheet reversing path 31, another sheet conveying guide of the sheet discharge path 26 and a sheet conveying guide of the post-fixing sheet conveying path 20. The outer and inner doors 63, 64 are each turnably supported on the apparatus main body so as to form a double door construction.

When a paper jam takes place in the switchback reversing path 27 or in the sheet reversing path 31, such a paper jam can be handled or cleared by first pulling out the unit U from the apparatus main body and then opening the outer door 63, as shown in FIG. 4, and when there takes place a paper jam in the fixing unit 14, such a paper jam can be handled or cleared further by opening the inner door 64, as shown in FIG. 5.

In addition, when there takes place a paper jam in the sheet re-feeding path 32, as shown in FIG. 4 and FIG. 5, such a paper jam is handled by pushing down a guide member 32*a* that forms the sheet re-feeding path 32.

At this time, since the clearance or handling of paper jams is difficult if the gate 42 is left at the apparatus main body side, such paper jam clearance or handling can be carried out more easily or efficiently when the gate 42 is supported at the guide member 32*a* side than when it is supported at the apparatus main body side.

When the guide member 32*a* is opened downwardly, as shown in FIG. 4, the gate 42 is supported by the guide member 32*a*, and it is urged in a direction indicated at F by means of an urging means so as to be maintained at a position shown in this figure.

On the other hand, the manually-fed-sheet conveying unit 62 shown in FIG. 1 is constructed, though not illustrated, to be of a door type or to be capable of being pulled out in a sidewise direction, thereby making it easy to handle paper jams.

According to this embodiment, it is possible to handle or clear paper jams occurring in the sheet reversing and discharging means, the sheet reversing path and/or the fixing unit 14 in an easy manner first by pulling out the component parts or devices related to the conveyance of sheets as the single unit U in a forward or frontward direction of the apparatus main body, and then by opening the sheet reversing and discharging means or sheet paths such as the sheet reversing path, etc. Therefore, it becomes unnecessary to perform paper jam clearance or handling from a side surface of the apparatus main body, as a consequence of which it is not necessary to move the sheet finishing applications installed at the side of the apparatus main body for clearance of paper jams, thus making it possible to reduce the space required for jam clearance operation.

Figure 9:
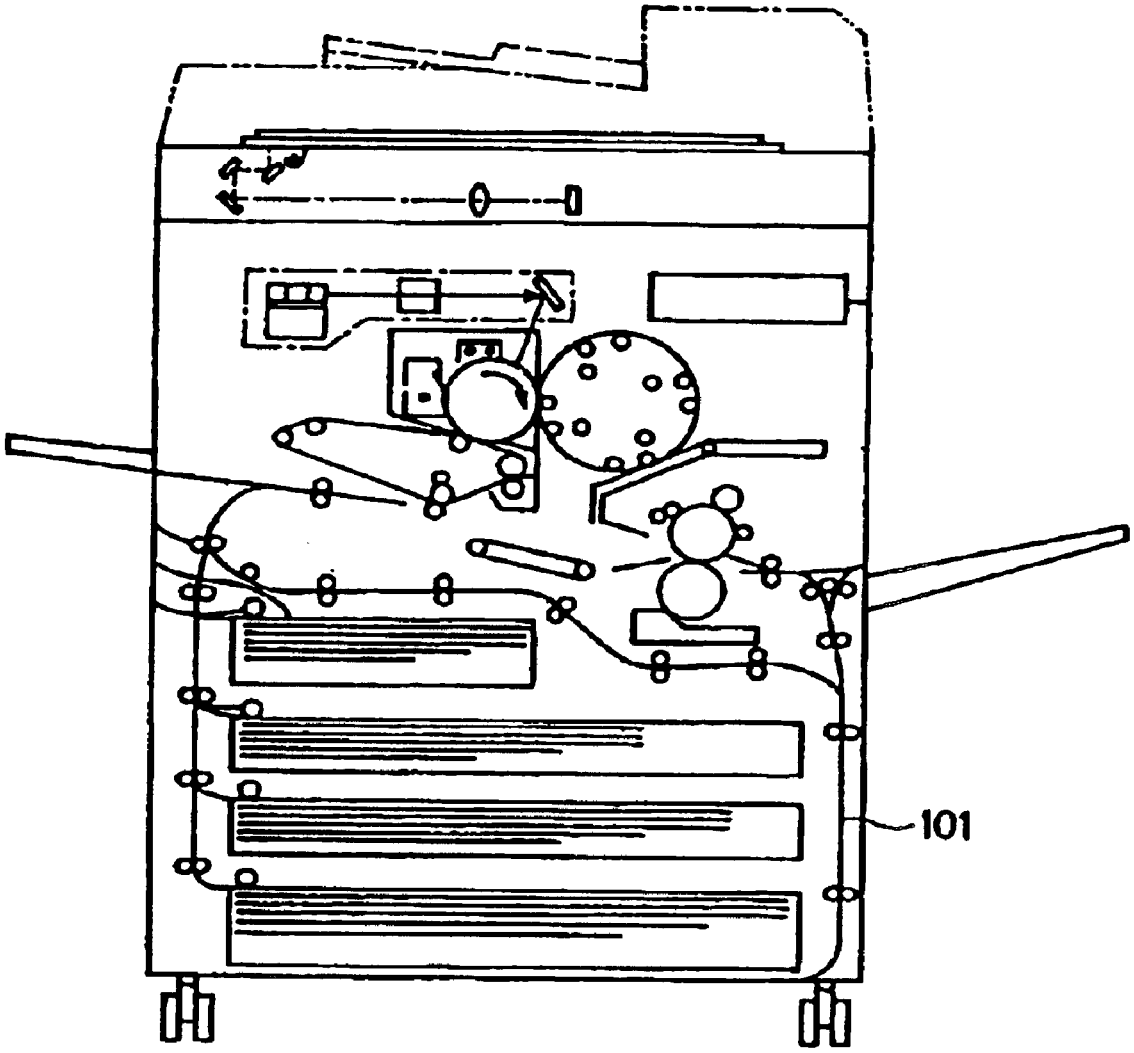
FIG. 9 is a cross sectional view of a conventional image forming apparatus.

In addition, by arranging the drawing path 37 at a location above the left-hand sheet deck 3 and the right-hand sheet deck 4, and by arranging the sheet re-feeding path 32 at a location above the drawing path 37, it becomes unnecessary to arrange sheet paths at one side of the apparatus main body unlike the case of the sheet reversing path 101 of the aforementioned conventional image forming apparatus shown in FIG. 9, as a result of which the apparatus main body can be reduced in size.

Since the sheet feeding path 7 for conveying the sheet fed from the left-hand sheet deck 3 cannot be drawn out from the apparatus main body, it is preferable to release pressure contact between the paired rollers of the sheet feeder 6 for conveying the sheet to the sheet feeding path 7 when the unit U is drawn out. As a result, when the unit U is drawn out upon occurrence of a paper jam in the sheet feeding path 7, the sheet jammed is drawn out together with the unit U.

Moreover, since it is constructed such that the outer door 63 and the inner door 64 are opened sidewise after the unit U has been drawn out from the apparatus main body for handling or clearing paper jams in the sheet reversing and discharging means and in the fixing unit 14, the left-hand rail 61 is arranged almost right over the discharge rollers 23 disposed at locations above the sheet reversing and discharging means.

On the other hand, the right-hand rail 61 is arranged between the registration unit 9 and the sheet re-feeding path 32 so that the space in the apparatus main body can be effectively utilized.

Figure 6:
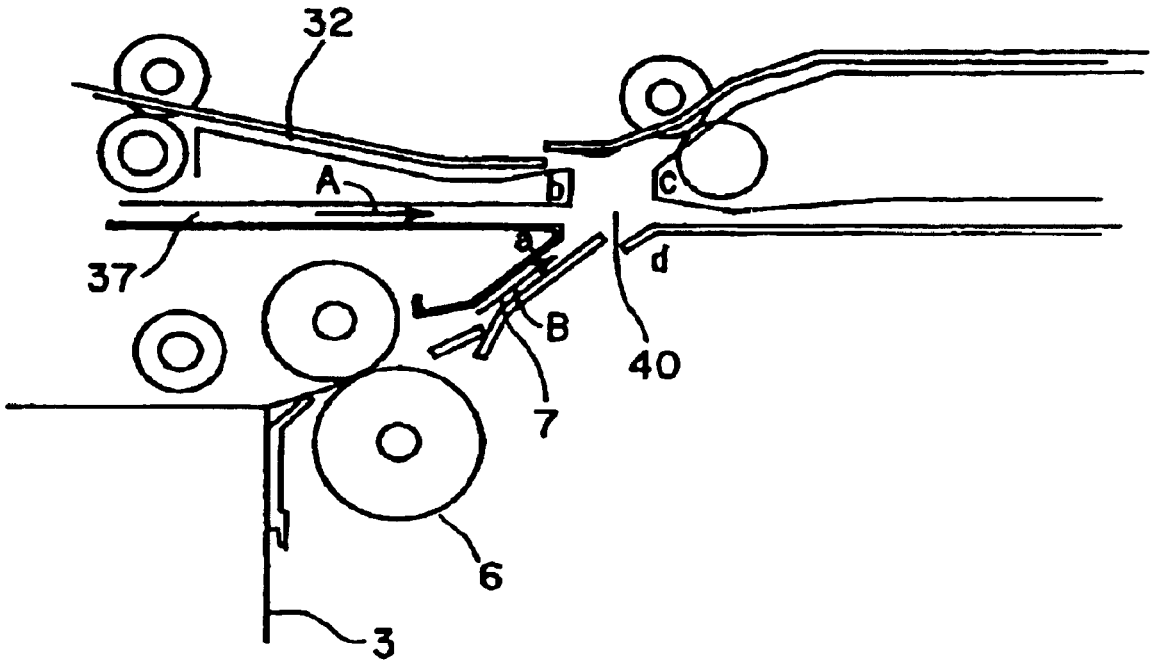
FIG. 6 is a schematic view of a portion at which a sheet feeding path and a sheet re-feeding path provided by the image forming apparatus shown in FIG. 1 join to each other.
Figure 7:
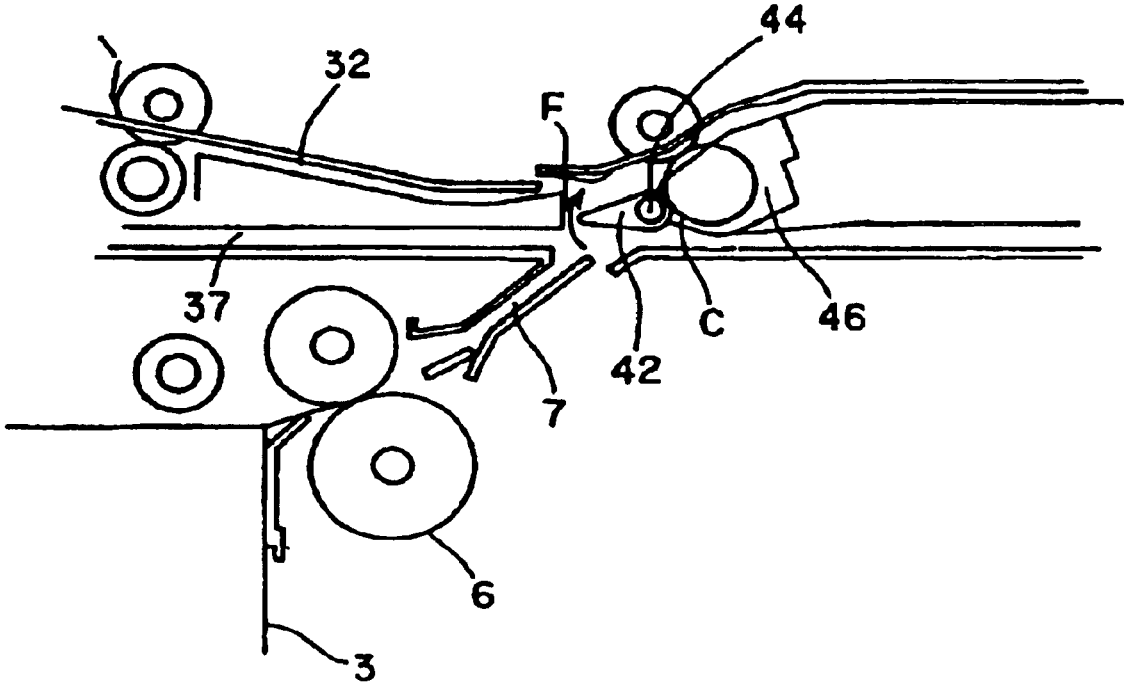
FIG. 7 is a schematic view of the portion at which the sheet feeding path and the sheet re-feeding path provided by the image forming apparatus shown in FIG. 1 join to each other.
Figure 8:
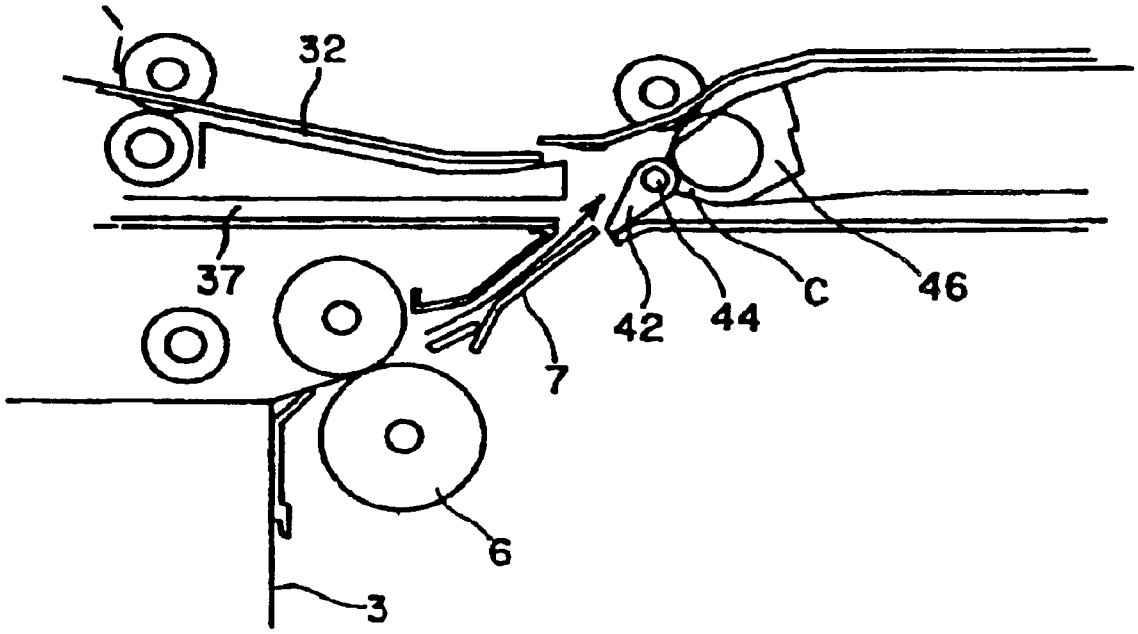
FIG. 8 is a schematic view of the portion at which the sheet feeding path and the sheet re-feeding path provided by the image forming apparatus shown in FIG. 1 join to each other.

Next, reference will be made to a portion at which the sheet feeding path 7 and the sheet re-feeding path 32 join to each other while referring to FIG. 6 through FIG. 8. FIG. 6 through FIG. 8 are schematic views showing the portion at which the sheet feeding path 7 and the sheet re-feeding path 32 of the image forming apparatus shown in FIG. 1 join to each other.

In this embodiment, by introducing the sheets fed from the left-hand sheet deck 3 into the sheet re-feeding path 32, a part of the sheet re-feeding path 32 is commonly utilized as a sheet feeding path extending from the left-hand sheet deck 3, thereby serving for the space saving of the sheet conveying path.

As shown in FIG. 6, a sheet fed from the left-hand sheet deck 3 is sent to the sheet re-feeding path 32 across the drawing path 37 through the sheet feeding path 7. At this time, if the sheet is to be conveyed to the sheet re-feeding path 32 by simply crossing the drawing path 37, there would be easily caused defective sheet conveyance such as the sheet being caught or jammed at the intersection 40.

In FIG. 6, sheets enter the intersection 40 between the sheet feeding path 7 and the drawing path 37 from two directions, i.e., in the direction of A and in the direction of B.

A sheet with an image formed on its one side surface, coming into the intersection 40 from the direction of A, has the possibility of being caught by corners c and d among four corners of the intersection 40 if the sheet has a large curl (deflection) depending upon the kind thereof. On the other hand, a sheet coming from the direction of B has the possibility of being caught by the other corners b and c of the intersection 40.

Such a catch of the sheet by the corners b and d can be avoided by consideration of arrangement including steps between the corner a and the corners b and d. For instance, the catch of the sheet can be avoided by making each of gaps between the corners a and b and between the corners a and d narrower by about 30–70% than an ordinary guide gap thereby to restrict the conveyance position of the sheet, and by providing sufficient steps between the corners a and b and between the corners a and d under the condition of the gaps thus narrowed.

However, a catch of the sheet by the corner c comes from the two directions of A and B, and hence can not be avoided in some cases.

Further, since the fixing unit applies heat to the surface of the sheet having an image formed thereon, a plain sheet and a thin sheet (i.e., basis weight (surface density) of 90 g/m$^2$ or less) often generate a heat curl that becomes convex at the image-formed surface side, and hence are easily caught by the corner c.

Thus, the swingable switching gate 42 is arranged at the corner c, as shown in FIG. 7, so that a curled sheet can be smoothly conveyed with a tip or leading end thereof being guided by the gate 42 without being caught by the corner c.

The gate 42 is controlled to be turned by means of an actuator 46 such as a solenoid. When a sheet from the sheet re-feeding path 32 is to be conveyed, the gate 42 is positioned as shown in FIG. 7. In addition, in cases where a sheet is to be conveyed from the left-hand sheet deck 3 through the sheet feeding path 7, the gate 42 is turned downwardly, as shown in FIG. 8, to remove a step with respect to the sheet feeding path 7, so that the sheet can be conveyed smoothly.

The gate 42 is urged in a direction of F indicated in FIG. 7 by means of the urging means, whereby it is positioned at a location shown in FIG. 7. When the actuator 46 is turned on, the gate 42 is caused to turn to a position shown in FIG. 8 against the urging force of the urging means under the action of the actuator 46.

Here, it is to be noted that a fulcrum of rotation 44 of the gate 42 is arranged in the range of the corner c, and hence the construction of the gate 42 can be simplified, and the operating area of the gate 42 can be made small, too. As a result, a further space saving can be achieved.

Furthermore, the fulcrum of rotation 44 of the gate 42 is arranged at a location below the sheet re-feeding path 32, so that the gate 42 is able to guide a sheet while being in contact with a lower surface of the sheet in the sheet re-feeding path 32. In other words, the gate 42 will guide a rear side surface of the sheet which has an image formed on a front side surface thereof. Therefore, even if the sheet is in a hot state just after the toner image has been fixed thereto, there would be created no defective image such as a rubbed or blurred image, a striped image, etc.

In addition, the fulcrum of rotation 44 of the gate 42 is arranged at a location above the drawing path 37, so that the gate 42 is able to guide a sheet while being in contact with an upper surface of the sheet drawn into the drawing path 37. In other words, the gate 42 will guide a surface of the sheet opposite to a surface thereof having an image formed thereon. Accordingly, the gate 42 does not cause any defective image such as a rubbed or blurred image, a striped image, etc., with respect to the sheet drawn into the drawing path 37.

What is claimed is:

1. An image forming apparatus comprising:

a plurality of sheet storage means;

image forming means for forming an image on a sheet fed from any of said sheet storage means;

a sheet re-feeding path for guiding again the sheet, which has a first image formed on one side surface thereof by said image forming means, to said image forming means so as to form a second image on the other side surface of the sheet; and a drawing path for drawing in the sheet to switchback it when the sheet having the first image formed thereon is sent to said sheet re-feeding path;

wherein said sheet re-feeding path is disposed substantially horizontally at a location below said image forming means;

said drawing path is disposed substantially horizontally between said sheet re-feeding path and said plurality of sheet storage means; and a sheet feeding path for feeding the sheet from said sheet storage means crosses said drawing path to join to said sheet re-feeding path.

2. The image forming apparatus according to claim 1, wherein said plurality of sheet storage means are disposed horizontally at locations below said sheet re-feeding path along a sheet conveying direction in said sheet re-feeding path; and said sheet feeding path for feeding the sheet from said sheet storage means disposed at an upstream side of said sheet re-feeding path in the sheet conveying direction thereof crosses said drawing path.

3. The image forming apparatus according to claim 1, further comprising a gate for guiding the sheet passing through an intersection at which said sheet feeding path and said drawing path cross each other.

4. The image forming apparatus according to claim 3, wherein said image forming means comprises fixing means for fixing a toner image transferred to the sheet; and said gate is disposed so as to guide a rear surface of the post-fixed sheet opposite to a surface thereof on which said toner image is fixed.

5. The image forming apparatus according to claim 3, wherein said gate is movable to a first position at which the sheet from said sheet feeding path is guided to a portion of said sheet re-feeding path disposed at a downstream side of said intersection, and to a second position at which the sheet from a portion of said drawing path disposed at an upstream side of said intersection is guided to a portion of said drawing path disposed at a downstream side of said intersection.

6. The image forming apparatus according to claim 5, wherein said gate when located at said second position serves to guide the sheet from a portion of said sheet re-feeding path disposed at an upstream side of said intersection to the portion of said sheet re-feeding path disposed at a downstream side of said intersection.

7. The image forming apparatus according to claim 5, wherein said gate is pivotable between said first position and said second position about a fulcrum of rotation thereof which is disposed at a downstream side of said intersection at a location between said sheet feeding path and said drawing path.

8. The image forming apparatus according to claim 7, further comprising:

urging means for urging said gate so as to position it to said second position; and an actuator for turning said gate to said first position against the urging force of said urging means.

9. The image forming apparatus according to claim 3, wherein said gate is mounted on a lower guide member forming a lower surface of said sheet re-feeding path, said gate being able to be drawn to a front side of said apparatus main body together with said lower guide member.

10. The image forming apparatus according to claim 9, wherein said lower guide member also serves as a member forming an upper surface of said drawing path.

11. The image forming apparatus according to claim 1, further comprising:

registration means for correcting skewing of the sheet at an upstream side of said image forming means;

discharge means for discharging the sheet after image formation to the outside of said apparatus main body; and sheet reversing and discharging means for switchbacking and guiding the sheet after image formation to said discharge means so as to reverse the sheet inside out to discharge it to the outside of said apparatus main body;

wherein said registration means, a fixing means constituting said image forming means, said sheet reversing and discharging means, and a guide member forming said sheet re-feeding path are constructed in such a manner that they are able to be integrally drawn out, as a unit, to a front side of said apparatus main body.

12. The image forming apparatus according to claim 11, wherein internal paths of said sheet reversing and discharging means are opened by opening a door to a side of said apparatus main body at a position of said unit at which said unit has been drawn out to the front side of said apparatus main body.

13. The image forming apparatus according to claim 11, wherein said guide member forming said sheet re-feeding path comprises: an upper guide member forming an upper surface of said sheet re-feeding path; and a lower guide member forming a lower surface of said sheet re-feeding path; and said lower guide member is movable downwardly to open said sheet re-feeding path at a position of said unit at which said unit has been drawn out to the front side of said apparatus main body.

14. The image forming apparatus according to claim 13, wherein said lower guide member also serves as a member forming an upper surface of said drawing path.

15. An image forming apparatus comprising:

a pair of sheet decks disposed in a horizontal direction in an apparatus main body for storing sheets, respectively;

an image forming unit disposed at a location above said pair of sheet decks;

a sheet feeding path connecting said sheet deck and said image forming unit with each other;

an output tray disposed at a side of said apparatus main body;

a sheet discharge path connecting said image forming unit and said output tray with each other;

a drawing path branching from said sheet discharge path so as to be disposed substantially horizontally at a location above said pair of sheet decks; and a sheet re-feeding path disposed substantially horizontally between said drawing path and said image forming unit for connecting said sheet discharge path and said sheet feeding path with each other;

wherein said sheet feeding path connected from one of said pair of sheet decks to said image forming unit crosses said drawing path to be connected with said sheet re-feeding path, whereby said sheet feeding path serves as a part of said sheet re-feeding path.

16. The image forming apparatus according to claim 15, further comprising a gate disposed at an intersection at which said sheet feeding path crosses said drawing path, said gate being pivotable between a substantially horizontal state for permitting said drawing path to draw in the sheet, and an inclined state for permitting said sheet feeding path to convey the sheet.

* * * * *

UNITED STATES PATENT AND TRADEMARK OFFICE

CERTIFICATE OF CORRECTION

PATENT NO. : 6,873,822 B2
DATED : March 29, 2005
INVENTOR(S) : Toshiro Tomono et al.

It is certified that error appears in the above-identified patent and that said Letters Patent is hereby corrected as shown below:

Column 2,
Line 55, “across sectional” should read -- a cross-sectional --.
Line 58, “cross sectional” should read -- cross-sectional --.

Column 3,
Lines 16, 39 and 41, “cross sectional” should read -- cross-sectional --.
Line 44, “manually” should read -- manual --.
Line 62, “manually” should read -- manual --; and “tray” should read -- trays --.

Column 4,
Line 8, “on” should read -- onto --.

Column 8,
Line 51, “of gaps” should read -- of the gaps --.

Column 12,
Line 9, “plane,” should read -- plane, and --.
Line 17, “an a” should read -- and a --.
Line 22, “in a” should read -- in an --.

Signed and Sealed this

Ninth Day of August, 2005

JON W. DUDAS
*Director of the United States Patent and Trademark Office*